US008191262B2

(12) United States Patent
Palmer et al.

(10) Patent No.: US 8,191,262 B2
(45) Date of Patent: Jun. 5, 2012

(54) DISPOSABLE, STERILE SURGICAL CLIPPER

(75) Inventors: Brian R. Palmer, Wauconda, IL (US); Dale F. Greeson, Palatine, IL (US); Earl D. Wilson, Ingleside, IL (US)

(73) Assignee: Medline Industries, Inc., Mundelein, IL (US)

( * ) Notice: Subject to any disclaimer, the term of this patent is extended or adjusted under 35 U.S.C. 154(b) by 561 days.

(21) Appl. No.: 12/261,461

(22) Filed: Oct. 30, 2008

(65) Prior Publication Data

US 2009/0106981 A1 Apr. 30, 2009

Related U.S. Application Data

(60) Provisional application No. 61/000,939, filed on Oct. 30, 2007.

(51) Int. Cl.
*B26B 19/02* (2006.01)
*A45D 26/00* (2006.01)

(52) U.S. Cl. ..... 30/34.05; 206/351; 606/133

(58) Field of Classification Search ..... 30/34.05, 30/42; 206/351; 606/133, 167; 422/21, 422/22

See application file for complete search history.

(56) References Cited

U.S. PATENT DOCUMENTS 1,938,159 A * 12/1933 Stewart ..... 206/207
2,447,183 A 8/1948 Irish et al.
4,221,049 A 9/1980 Hamashima
4,482,053 A * 11/1984 Alpern et al. ..... 206/439
4,511,035 A 4/1985 Alpern
4,563,814 A 1/1986 Trichell et al.
4,581,822 A 4/1986 Fujimura
4,667,405 A 5/1987 Trichell et al.
4,700,476 A 10/1987 Locke et al.
4,765,060 A 8/1988 Veselaski et al.
4,776,095 A 10/1988 Tsujimoto et al.
4,813,133 A 3/1989 Locke et al.
4,899,444 A 2/1990 Trichell et al.
5,050,304 A 9/1991 Fujikawa et al.
5,054,199 A 10/1991 Ogawa et al.
5,123,159 A 6/1992 Kubo et al.
5,165,172 A 11/1992 Weinrauch
5,237,750 A 8/1993 Nakano et al.
5,325,589 A 7/1994 Kubo
5,367,772 A 11/1994 Ogawa
5,579,581 A 12/1996 Melton
5,606,799 A 3/1997 Melton
5,715,943 A 2/1998 Thompson, Jr.
5,846,254 A * 12/1998 Schulze et al. ..... 606/148
(Continued)

OTHER PUBLICATIONS

International Search Report & Written Opinion, International Application No. PCT/US2008/081731, dated Jan. 16, 2009 (11 pages).

*Primary Examiner* — Stephen Choi
(74) *Attorney, Agent, or Firm* — Nixon Peabody LLP

(57) ABSTRACT

A disposable, sterilized surgical clipper includes a body having a top portion and a bottom portion and a clipper head attached to the top portion of the body. The clipper head includes a housing and a blade assembly. A power source is housed within the body for operating the clipper. The clipper head and the body may be a single, integrated unit or the clipper head may be removable from the body. In either embodiment, the body, clipper head and power source are sterilized as a single unit so as to be used in a sterile setting.

22 Claims, 6 Drawing Sheets

U.S. PATENT DOCUMENTS

| | | | |
|---|---|---|---|
| 6,076,263 | A | 6/2000 | Andis et al. |
| 6,314,648 | B1 | 11/2001 | Hillebrandt |
| 6,473,973 | B2 | 11/2002 | Laube |
| 6,742,262 | B2 | 6/2004 | Rizzuto, Jr. et al. |
| 6,862,810 | B2 | 3/2005 | Braun et al. |
| 6,880,808 | B2 | 4/2005 | McPeak et al. |
| 6,886,255 | B2 | 5/2005 | Freas et al. |
| 7,010,859 | B2 | 3/2006 | Laube |
| 7,080,458 | B2 | 7/2006 | Andis |
| D535,786 | S | 1/2007 | Gianninin et al. |
| 2003/0131480 | A1* | 7/2003 | Leung et al. ..... 30/210 |
| 2004/0049921 | A1 | 3/2004 | Freas et al. |
| 2006/0230621 | A1 | 10/2006 | Liao |
| 2006/0283022 | A1 | 12/2006 | Oh |
| 2007/0044320 | A1 | 3/2007 | Fukutani et al. |
| 2007/0044604 | A1 | 3/2007 | Andis et al. |

* cited by examiner

DISPOSABLE, STERILE SURGICAL CLIPPER

CROSS-REFERENCE TO RELATED APPLICATION

This application claims the benefit of U.S. Provisional Patent Application No. 61/000,939, filed Oct. 30, 2007 entitled "Disposable, Sterile Surgical Clipper", which is hereby incorporated by reference in its entirety.

FIELD OF THE INVENTION

The present invention relates generally to surgical clippers for removing hair at surgical sites. More particularly, the present invention relates to surgical clippers that are sterilized for use in an operating room or sterile setting and are disposed of after a single use on a patient.

BACKGROUND OF THE INVENTION

Hospitals and surgery centers often need to remove body hair from patients at a surgical site prior to performing a surgical procedure. Straight blade razors are generally not the preferred mode of removing hair as these devices may inadvertently nick or cut a patient's skin and, therefore, introduce the possibility of infections at the surgical site. Because of such problems, electric clippers are a preferred mode of hair removal in hospitals and surgery centers in order to prevent surgical site infections. However, there are currently no sterile electric clippers available to hospitals and surgical centers. In some cases, the disposable clipper heads alone may be packaged and sterilized for use in the hospital or surgery center. However, once the sterile clipper head is attached to a clipper body that is not sterile, the entire unit, including the clipper head, becomes non-sterile and is unable to be used in a sterile setting.

Therefore, there exists a need for a surgical clipper that may be sterilized as a complete unit and that is disposed of after use on a single patient.

BRIEF DESCRIPTION OF THE DRAWINGS

The foregoing and other advantages of the invention will become apparent upon reading the following detailed description and upon reference to the drawings.

Figure 1:
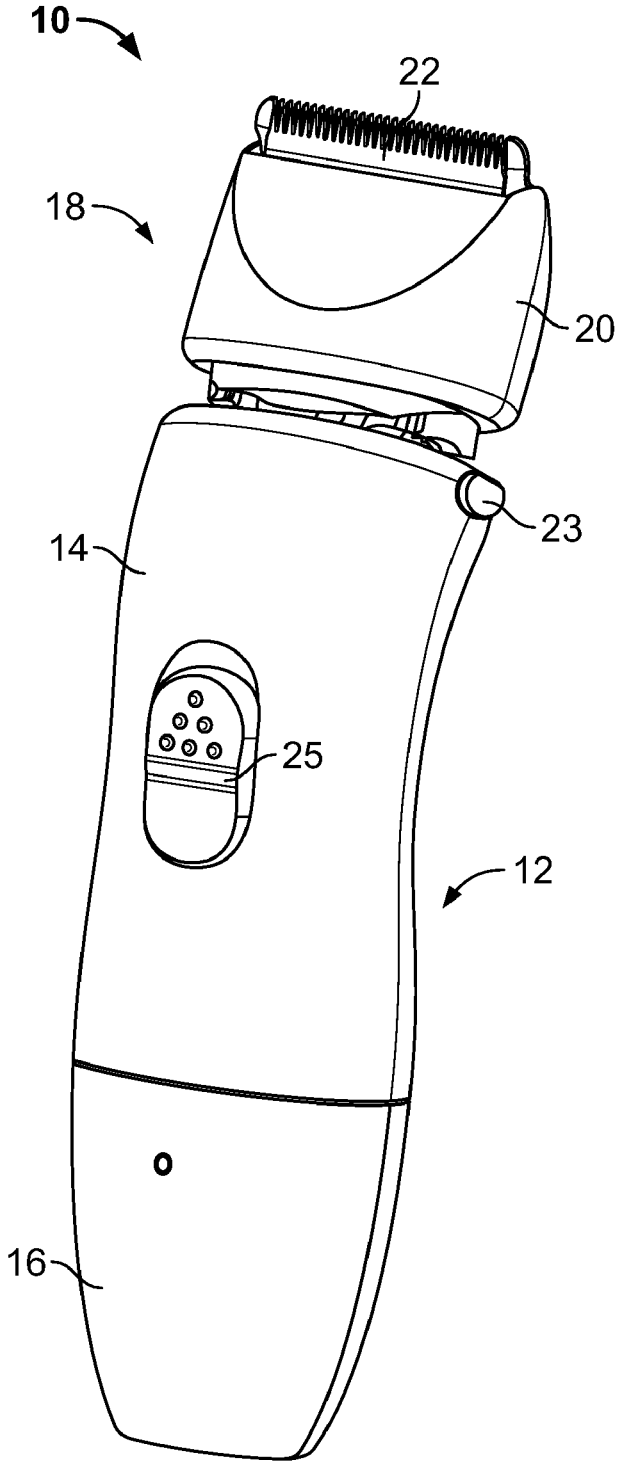
FIG. 1 is a perspective view of a surgical clipper according to one embodiment.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention.

DESCRIPTION OF ILLUSTRATIVE EMBODIMENTS

Turning to FIG. 1, a surgical clipper 10 is shown. The surgical clipper 10 includes a body 12 consisting of a top portion 14 and a bottom portion 16. A clipper head 18 is adapted to attach to the top portion 14 of the body 12. The clipper head 18 may include a housing 20 and a blade assembly 22. The clipper head 18 may be attached via one or more releasable buttons 23 on the body 12, or via other suitable mechanisms for attachment. As an alternative to having a clipper head 18 that is attachable/detachable, the clipper head 18 may be integrated with the body 12 of the surgical clipper 10 such that the clipper head 18 and body 12 are manufactured as a single, unitary device. One exemplary illustration of one such alternative embodiment will be described in detail below with respect to FIGS. 5 and 6.

Also included in the surgical clipper 10 is power button 25 for activating the surgical clipper 10 to cut the hair of a patient. The power button 25 activates a motor (not shown in FIG. 1) that drives the movement of the blade assembly 22. The blade assembly 22 may be comprised of one or more blades for cutting the hair of a surgical patient. The motor is powered by a power source described in more detail below.

Figure 2:
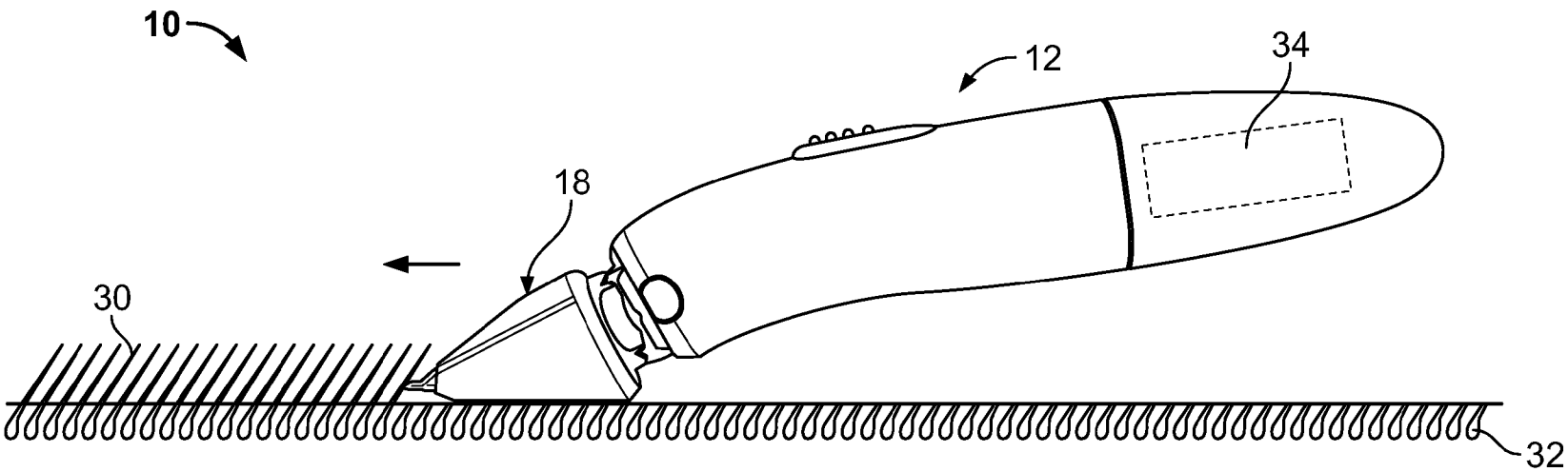
FIG. 2 is a side view of the surgical clipper of FIG. 1.

FIG. 2 illustrates a side view of the surgical clipper 10 being used to clip the hair 30 from a body surface 32. The advantages of using a surgical clipper 10 to cut body hair 30 is that the surgical clipper 10 is not likely to inadvertently cut or nick the patient's skin and, thus, will not expose the patient to possible infections at the surgical site. According to the present concepts, the surgical clipper 10 may be packaged and sterilized such that the entire unit is sterile and can be used in a sterile setting, such as a hospital operating room or other surgical setting.

The surgical clipper 10 in FIGS. 1 and 2 includes a power source 34 within the body 12 of the surgical clipper 10. The power source 34 may include one or more disposable or rechargeable batteries. For example, the batteries may be disposable, single-use alkaline batteries, such as a standard AA battery. These batteries or other power source may be sterilized along with the clipper head 18 and body 12 as discussed in more detail below.

In order to provide a surgical clipper 10 that is packaged as a sterile unit, the entire unit must be capable of withstanding the sterilization process, which may include radiation sterilization, ethylene oxide sterilization, steam or other suitable methods of sterilization. The type of sterilization process selected may depend on a variety of factors such as cost, materials to be sterilized, level of sterilization needed, etc. Thus, the materials that make up the body 12 and clipper head 18 of the surgical clipper 10 and the interior components of the surgical clipper 10 must be made of materials that are sterilizable and whose performance after sterilization is not compromised by the sterilization process. For example, it has been found that some materials, such as certain low grades of acrylonitrile butadiene styrene (ABS) plastic, polypropylene and low grade nylon, after undergoing the sterilization process, produce breaks or fractures in the material that may affect the performance of the surgical clipper 10. As the performance of the surgical clipper 10 is critical in the operating room, surgical setting or sterile setting, the use of materials in a completely sterile unit that may be compromised during the sterilization process is unacceptable.

The material used in the surgical clipper 10 described herein is designed to withstand the sterilization process to provide a single, disposable, packaged unit that can be opened and used in a sterile setting and then discarded. This is possible due to the use of certain materials (e.g., radiation resistance grade materials) in the body 12, clipper head 18 and internal components of the surgical clipper 10 that have been found to resist breaking or fracturing during the sterilization process. For example, certain high grades of ABS (acrylonitrile butadiene styrene), high grades of nylon, high grades of polyoxymethylene (POM), combinations thereof, and/or the like have been found to withstand the sterilization process without breaking or fracturing and are able to perform successfully in a single, sterilized unit. These high grades of ABS, nylon and POM contain little or no impurities (e.g., less than about 1% impurities), such as unreacted monomers that did not bond during the molding process. While some materials are naturally resistant to the effects of radiation, other materials are not but can be made resistant by adding additives (e.g., free radical scavengers) to promote more efficient bonding during the molding process. High grade materials generally resist breaking, fracturing or shattering when dropped. Also, high grade materials do not generally deteriorate when washed with water or disinfectants and are better able to withstand varying temperatures. Low grade materials, on the other hand, contain higher impurities and exhibit poor performance in the areas of chemical resistance, temperature resistance, cracking, flexibility, tensile strength and brittleness.

To determine the materials that can withstand the sterilization process described herein, sterilization performance tests may be performed. Such tests allow various materials to be evaluated under standard sterilizing conditions. For example, under one set of sterilization tests, a given dosage of radiation, i.e., 60 kilogreys (kGy), is applied to the material to be tested. After sterilization, the material is evaluated to determine the durability of the material after sterilization and to determine whether any portions of the material developed cracks, breaks or fractures that would cause the material to be unsuitable for use in the sterile clipper 10. Other sterilization tests may require higher or lower dosages of radiation.

In some cases, the ability to withstand the sterilization process depends on the method and dosage of radiation used. For example, when using gamma radiation to sterilize the sterile clipper 10, high dosages may be applied, i.e., 50-60 kilogreys (kGy) or more. Under these conditions, high grades of ABS, nylon and POM are required to withstand the sterilization process. Lower grades of ABS, nylon and POM are unlikely to perform well under these dosages of radiation. Therefore, the method and the dosage of radiation required for sterilization may influence the types of materials used to manufacture the sterile clipper 10.

In addition to having material in the body 12 and clipper head 18 of the surgical clipper 10 that can withstand the sterilization process without breaking or fracturing, the power source 34 must also be capable of withstanding the sterilization process to achieve a completely sterilized unit. A set of tests may be performed, such as a battery life test, to confirm that the battery's life expectancy will meet certain design requirements. The effects of a radiation based sterilization process on material integrity and battery life were tested for one embodiment of the surgical clipper disclosed herein; the results of such testing are described in detail below.

Figure 3:
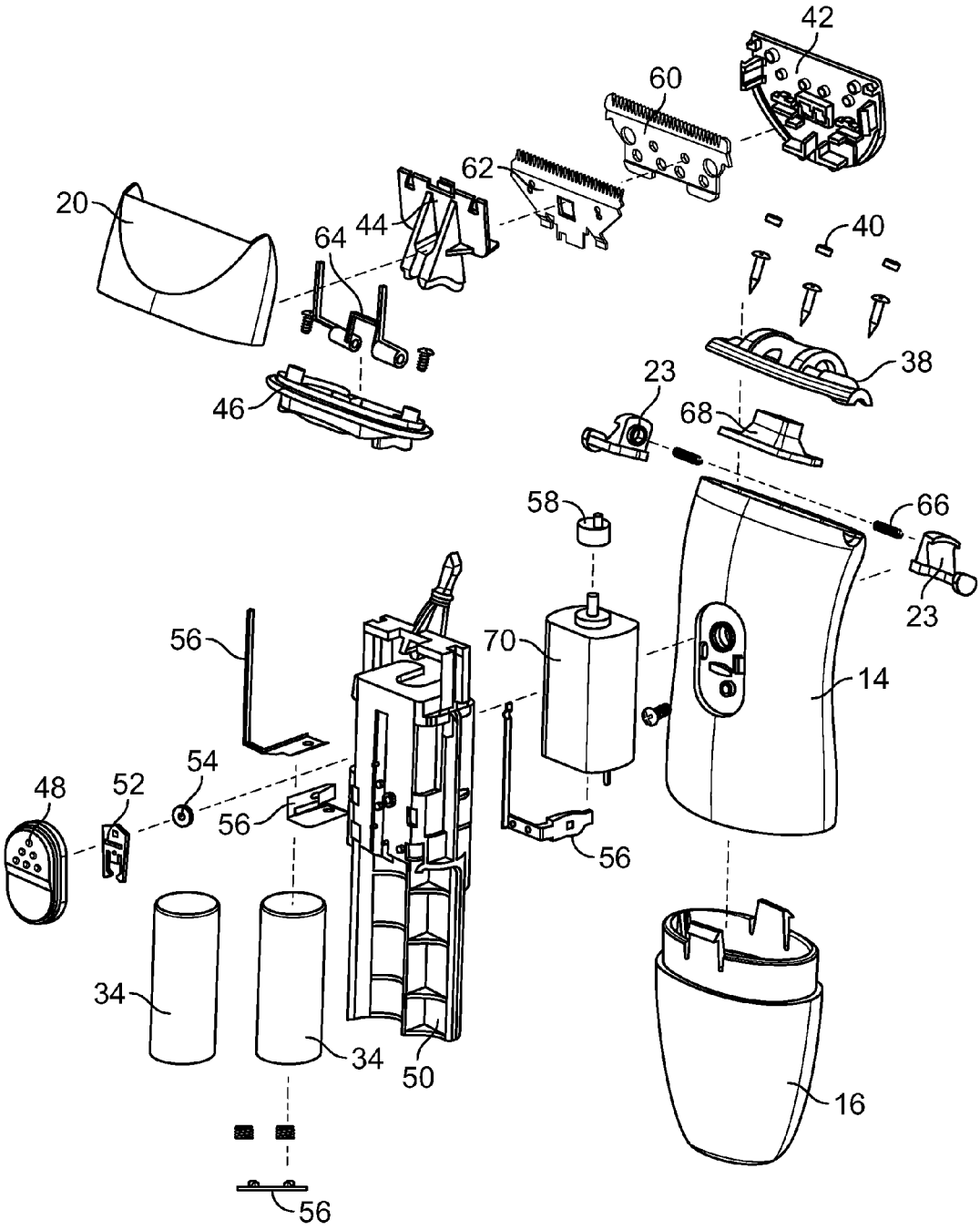
FIG. 3 is an exploded view of the surgical clipper of FIG. 1.

FIG. 3 illustrates an exploded view of the surgical clipper 10 having various components. These components are examples of components that may be included in the body 12 and clipper head 18 of a surgical clipper 10 and are not meant to indicate that only these components can be used with the devices described herein or that all of these components must be present in the surgical clipper 10. As one example, FIG. 3 indicates the different components that may be present and the relative positions of those components in the surgical clipper 10. It is contemplated that various components, not necessarily those shown in the drawings, may be included in surgical clippers 10 of the present concepts and may be made from materials that withstand the sterilization process, including thermoplastic polymers such as high grades of ABS, nylon and POM. It is also contemplated that one or more of the components of the surgical clipper 10 may be made from or supplemented with other suitable, sterilizable materials such as metals (e.g., stainless steel, brass, nickel, aluminum), silicone, thermoplastic elastomers, rubber, latex, polyester, polyisoprene, nitrile, urethane, combinations thereof and/or the like.

In one particular embodiment, the surgical clipper includes components that are made from high-grades of ABS, nylon and POM, as well as stainless steel, brass and/or rubber. These materials, once sterilized, continue to perform without instances of breaking, fracturing or other problems that may be associated with the sterilization process.

Several of the components of the surgical clipper 10 in the particular embodiment of FIG. 3 may be made from high grades of ABS, nylon (e.g., Nylon 66), and POM. Such components may include, for example: the top portion 14, the bottom portion 16, a cover plate 38, one or more screw caps 40, a blade base 42, a moving blade driver 44, a housing 20, a housing base 46, a switch button 48, a motor frame 50, one or more release buttons 23, a switch plate 52 and an eccentric wheel 54. While these components illustrate the types of parts that may be made from high grades of ABS, nylon, POM or other materials that withstand the sterilization process, it is envisioned that different parts, in addition to or alternative to those mentioned above, may be included in the surgical clipper 10 and may be made from high grades of ABS, nylon, POM, combinations thereof or other materials that withstand the sterilization process. The components listed above are included to provide examples only and are not meant to limit the embodiments described herein to use of high grades of ABS, nylon and POM with those specific components. As mentioned above, different surgical clippers 10 may have different components that may be made from high grades of ABS, nylon, POM or other materials that withstand the sterilization process. In some embodiments, high grade ABS, which is relatively durable, may be used for the body and other components of the surgical clipper that must be relatively rigid. High grade nylon, on the other hand, may be used for components that may need to more flexible. Although high grades of ABS, nylon and POM have been mentioned specifically, it is expected that other thermoplastic materials may perform similarly to high grades of ABS, nylon and POM and would be acceptable as materials for the surgical clipper 10 described herein.

Other components of the surgical clipper 10 may be made from non-thermoplastic materials, such as metals and/or rubber. In some particular embodiments, some of the components may be made from stainless steel or brass. For example, contacts 56 and an eccentric wheel shaft 58 may be made from brass; a fixed blade 60, a moving blade 62, a torsion bar spring 64 and a spring for a release button 66 may be made from stainless steel. Other metals may be used including nickel, aluminum, etc. Additionally, a waterproof cap 68 may be made from any suitable elastic material such as, for example a rubber material in order to provide a water "tight" seal. It is also contemplated that certain types of rubber, particularly types that are more rigid, may be used in place of some of the thermoplastic materials discussed herein. Other materials that may be used for one or more components of the sterile clipper 10 include silicone, thermoplastic elastomers, natural rubber or latex, polyester, polyisoprene, nitrile, urethane and/or combinations thereof. All such materials, however, must also be able to withstand the sterilization process as detailed above.

In order to power the surgical clipper 10, a motor 70 is also included in the surgical clipper 10 and must be able to withstand the sterilization process. The motor 70 may be comprised of typical metal materials, such as stainless steel, brass, copper, etc. The motor 70 is powered by the power source 34, which may include one or more disposable or rechargeable batteries, etc. Thus, once assembled, the surgical clipper 10 is made from materials that are capable of withstanding the sterilization process and that perform without breaking or fracturing of the materials following sterilization.

Figure 4:
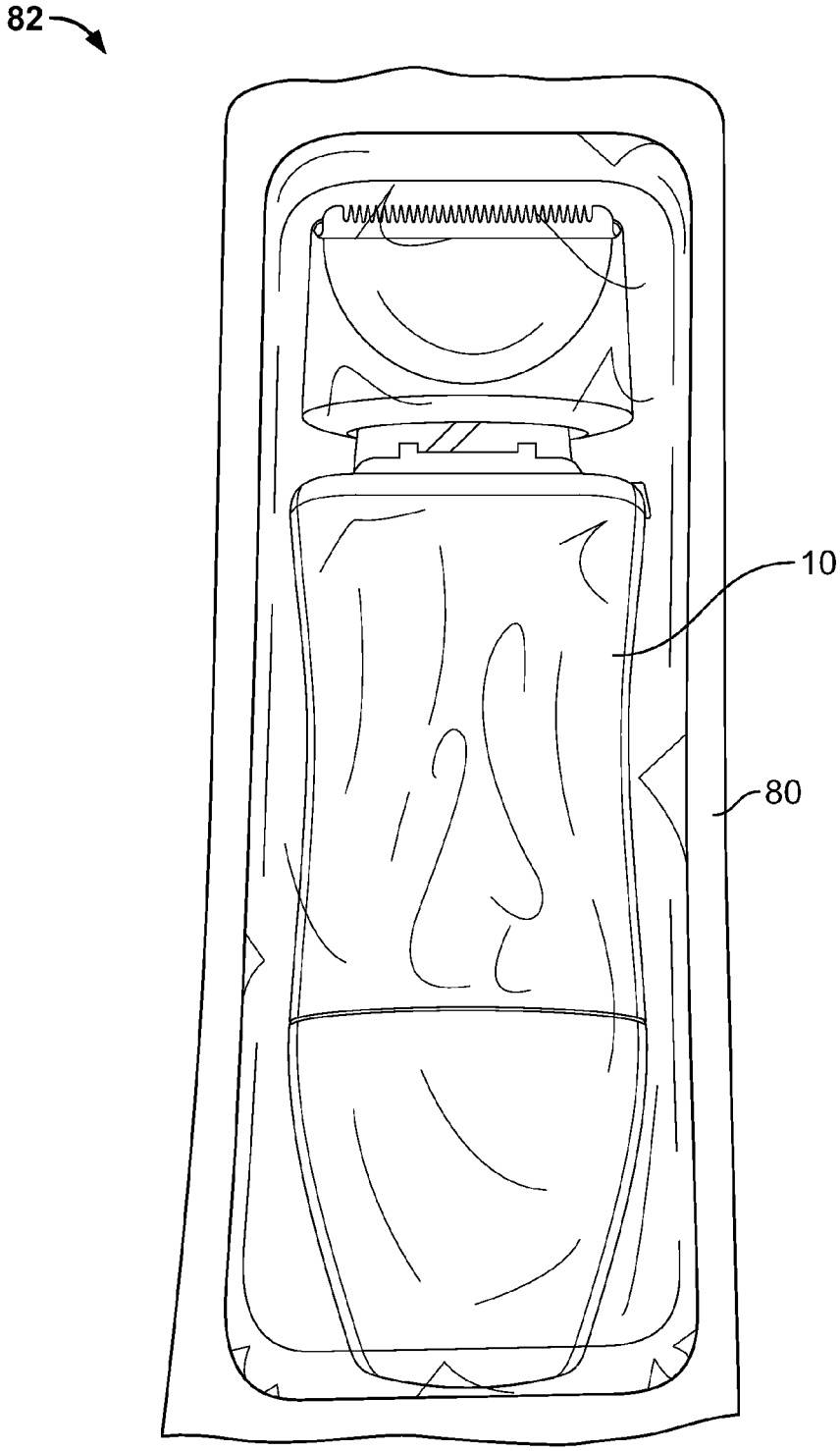
FIG. 4 is a perspective view of the surgical clipper enclosed within packaging material.

After the surgical clipper 10 is assembled but prior to sterilization, the surgical clipper 10 may be inserted into packaging. FIG. 4 illustrates the surgical clipper 10 of the present concepts enclosed in packaging 80. The packaging 80 completely surrounds the surgical clipper 10 and is sealed to protect the entire device, i.e., the body 12, the clipper head 18, and the power source 34 (not shown). The packaged clipper comprises a kit 82 that may be sterilized and supplied to a user as a completely sterile unit. Thus, the packaging 80 must also be durable and capable of withstanding the sterilization process.

The packaging 80 that may be used with the surgical clipper may include a bottom film, which may be rigid or flexible, and a top material. Non-limiting examples of suitable materials for the bottom film and/or the top material are poly/nylon-based film, paper, Tyvek, combinations thereof and the like. The packaging 80 may be processed via a full form-fill-seal (FFS), foil package, or pouch validation operation, as well as other suitable packaging processes. In one example of an FFS operation, the bottom film is heat and/or vacuum formed into a specified shape, i.e., a "cup." The surgical clipper 10 is placed in the shaped cup and is slid down a chain-driven conveyor such that it meets the top material. The top material is heat-sealed onto the formed cup, thus sealing the surgical clipper 10 inside of the sealed packaging 80. Examples of the foil and pouch operations include a pre-made package that is sealed, normally on three sides. The surgical clipper 10 is inserted into the pouch (by either a person or machine) via an open side of the package. The package is then closed by sealing the edges of the open side. This procedure ensures that the packaging 80 is capable of withstanding the rigorous environments of sterilization, shipping and warehouse storage. Guidelines for validation of packaging procedures are provided in FDA Guidance Document GHTF/SG3/N99-10:2004, "Quality Management Systems—Process Validation Guidance." It is contemplated that according to some embodiments, the processes for packaging the surgical clippers 10 meets these FDA guidelines.

After the sealing and packaging process is completed, additional tests may be performed to verify the destruction of microorganisms as a result of the sterilization process. These tests, referred to as "bioburden tests," determine the total number of viable organisms in or on a medical device. To verify the destruction of microorganisms, the bioburden test would be performed after the sterilization process is completed. The term "bioburden" itself refers to the number of microorganisms with which an object is contaminated. One example of a bioburden test, which may be performed to determine the total number of viable organisms in or on a surgical clipper and/or packaging is described in further detail below.

Once the surgical clippers 10 are sealed in the packaging 80 and sterilized, the kits 82 may be distributed to various hospitals, surgery centers and healthcare facilities without losing the sterility of the surgical clippers 10. Once received, the kits 82 may be opened by hospital and healthcare personnel for use in a sterile setting, such as an operating room, surgical site, sterile room, etc. As the entire surgical clipper 10 is sterile, it can be used to remove hair from a surgical site in an operating room, surgical setting or sterile setting and then be disposed of after use. Such devices also offer the advantages of being a cost effective, inexpensive alternative to other devices for removing body hair.

Figure 5:
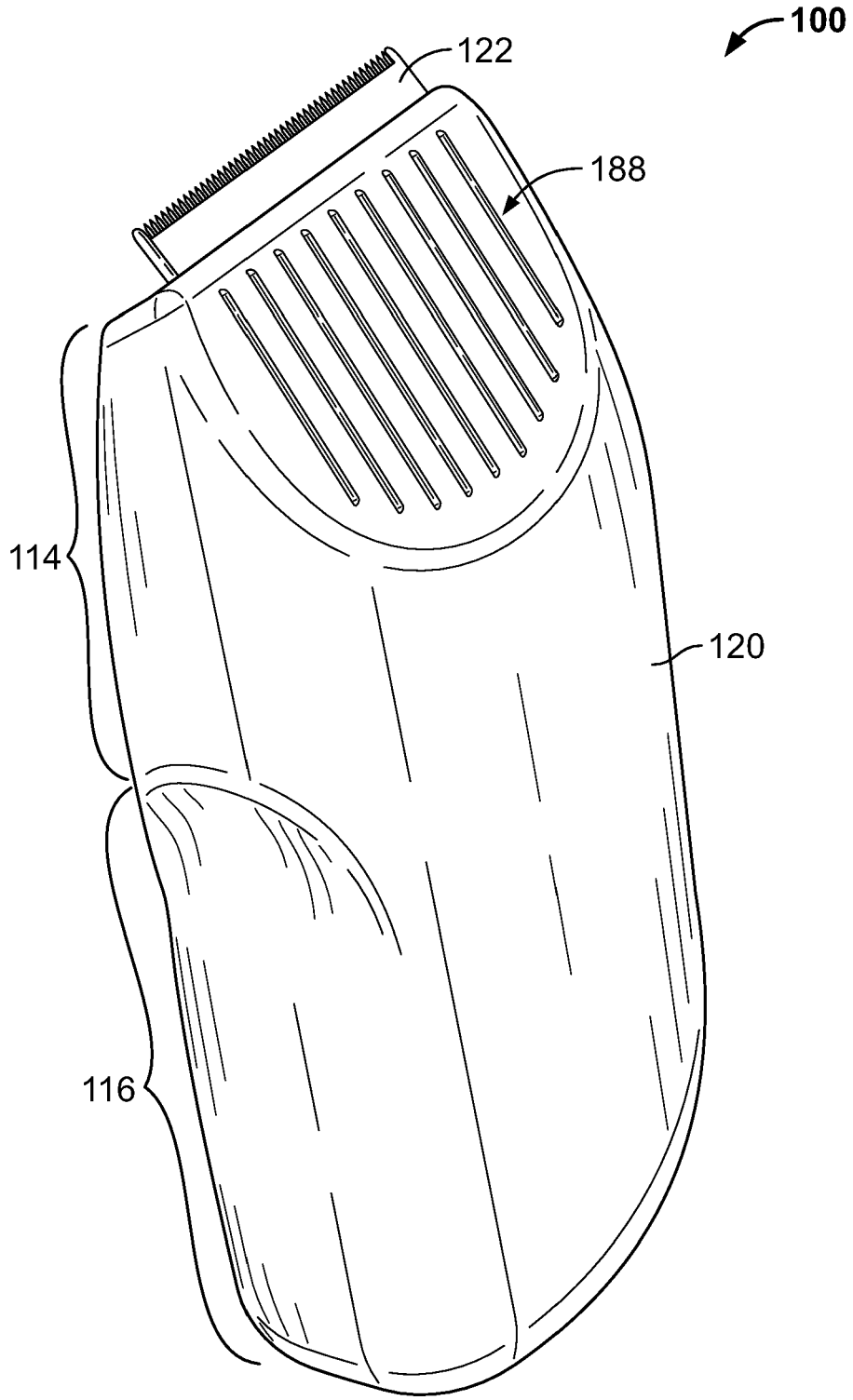
FIG. 5 is a perspective view of a surgical clipper according to an alternative embodiment.
Figure 6:
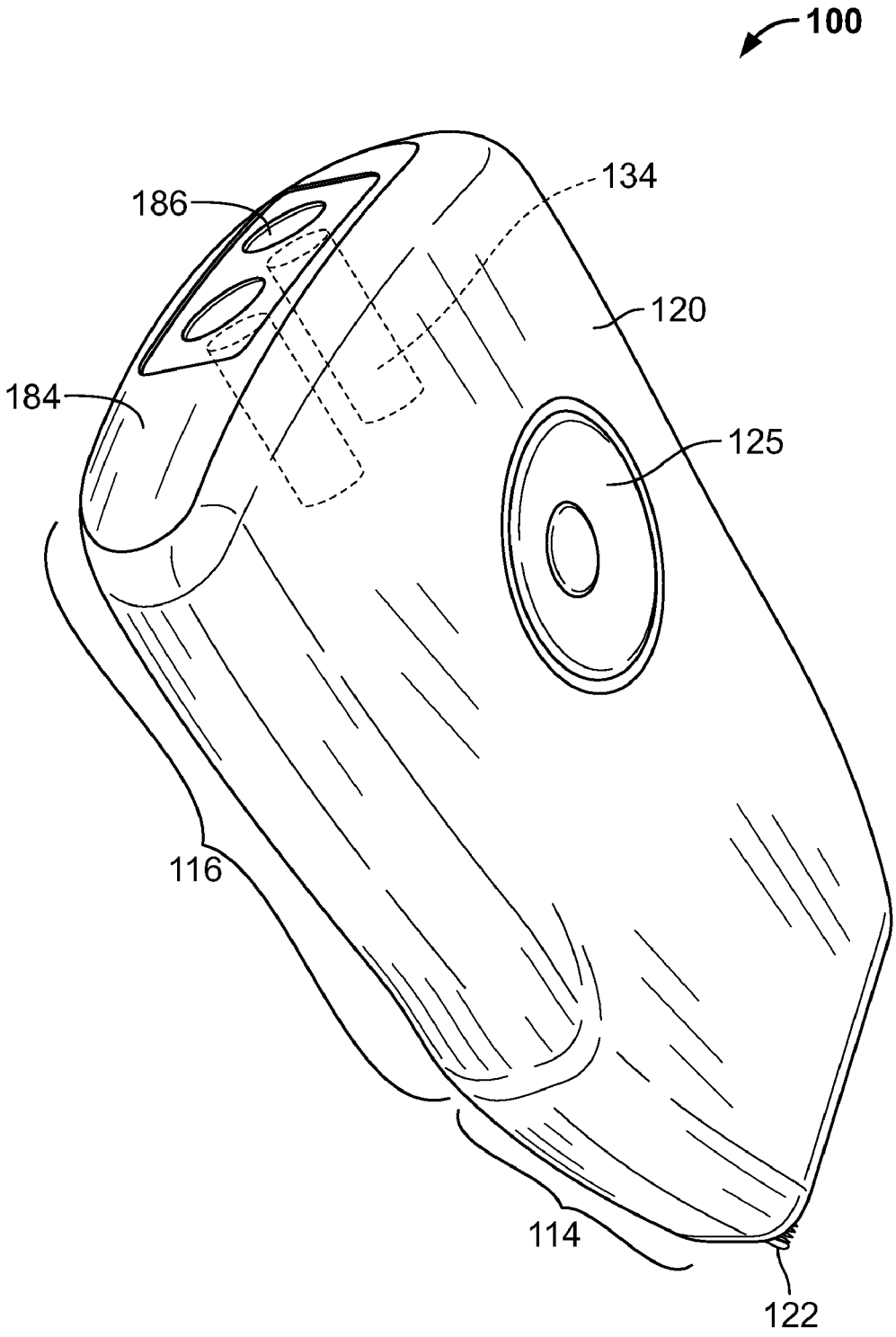
FIG. 6 is another perspective view of the surgical clipper of FIG. 5.

Referring to FIGS. 5 and 6, an alternative embodiment of a surgical clipper 100 is shown. The surgical clipper 100 is manufactured as a single, unitary device instead of including an attachable/detachable clipper head and body. The surgical clipper 100 includes a housing 120 having a top portion 114 and a bottom portion 116. A blade assembly 122 is located at the top portion 116 of the housing 120. A lower surface of the housing 120 can have a sloped portion 188 near the blade assembly 122 to promote proper orientation of the blade assembly 122 relative to the patient's skin while cutting the hair of the patient.

The surgical clipper 100 also includes a power button 125 for activating the surgical clipper 100 to cut the hair of a patient. The power button 125 activates a motor (not shown in FIGS. 5-6) within the housing 120 that drives the movement of the blade assembly 122. The blade assembly 122 may be comprised of one or more blades for cutting the hair of a surgical patient. The motor is powered by a power source 134 as described above with respect to the clipper 10 of FIGS. 1-4 such as, for example, one or more disposable or rechargeable batteries.

The power source 134 can be secured within the housing 120 of the surgical clipper 100 by any suitable means. For example, the housing 120 can include a bottom panel 184 at the bottom portion 116 of the housing 120, which provides access to an internal cavity that is configured to receive and electrically connect the power source 134 to additional interior components of the surgical clipper 100. The bottom panel 184 can be permanently secured to the housing 120 by, for example, bolts, rivets, glue, sonic welding or press fitting, or removably secured to the housing 120 by, for example, screws 186.

The surgical clipper 100 can further include additional interior components within the housing 120. For example, the surgical clipper 100 can include any of the interior components illustrated in and described with respect to FIG. 3 for surgical clipper 10. Again, those components described with respect to FIG. 3 are intended as examples of components that can be included within the housing 120 and are not meant to indicate that only these components can be used with the surgical clipper 100 or that all of these components must be present in surgical clipper 100.

As described above with respect to the embodiment of FIGS. 1-4, the housing 120 of the surgical clipper 100, the blade assembly 122, the motor (not shown), the interior components of the surgical clipper 100 and the power source 134 must be capable of withstanding the sterilization process to achieve a completely sterilized unit. Thus, the housing 120, the blade assembly 122, the motor, the interior components and the power source 134 of the surgical clipper 100 can be made from materials such as those previously described to ensure that material integrity and performance after sterilization are not compromised by the sterilization process.

As described above with respect to FIG. 4, after the surgical clipper 100 is assembled but prior to sterilization, the surgical clipper 100 may be inserted into packaging. The packaging completely surrounds the surgical clipper 100 and is sealed to protect the entire device, i.e., the housing 120, the blade assembly 122, and the power source 134. The packaging is made from materials and processed, as described above with respect to FIG. 4, such that the packaging is capable of withstanding the rigorous environments of sterilization, shipping and warehouse storage. Thus, the packaged clipper 100 comprises a kit that may be sterilized and supplied to a user as a completely sterile unit.

While these materials and components described above illustrate some embodiments of the present concepts, it is contemplated that other combinations of materials and components are meant to be covered by the embodiments described herein. For example, different components, materials, shapes, designs, etc. may be used based on various factors, such as feedback from customers, clinicians, or others who may use the surgical clipper 10 or the surgical clipper 100.

As discussed above, various sterilization processes can be implemented for sterilizing the surgical clippers disclosed herein. The guidelines and/or standards for the sterilization of health care products are prepared by the Association for the Advancement of Medical Instrumentation (AAMI). One particular sterilization process involves applying radiation to the surgical clippers. The AAMI has issued "American National Standards" under ANSI/AAMI/ISO 11137-1:2006, 11137-2:2006 and 11137-3:2006, entitled "Sterilization of health care products—Radiation—Part 1: Requirements for development, validation, and routine control of a sterilization process for medical devices," "Sterilization of health care products—Radiation—Part 2: Establishing the sterilization dose" and "Sterilization of health care products—Radiation—Part 3: Guidance on dosimetric aspects," respectively. The AAMI has also issued ANSI/AAMI/ISO 11135:1994, entitled "Medical devices—Validation and routine control of ethylene oxide sterilization." These standards and guidelines are recognized by the U.S. Food and Drug Administration (FDA) as acceptable methods to meet the FDA's expectation of achieving a $10^{-6}$ Sterility Assurance Level (SAL). The SAL is the probability that a unit of product contains one or more viable microorganisms. The $10^{-6}$ SAL is the level of sterility at which a medical device is considered to have an absence of microorganisms. It is contemplated that according to some embodiments, the surgical clippers are sterilized to $10^{-6}$ SAL using the above mentioned AAMI sterilization standards and guidelines.

According to the AAMI standards and guidelines, a sterilization dose is the dose of radiation to which the product is exposed to ensure a product achieves $10^{-6}$ SAL. The sterilization dose is determined from the results of a bioburden test performed on a number of non-sterilized product samples. The results of the bioburden test (i.e., average bioburden per product sample) indicate the number and types of microorganisms found on a typical product sample prior to being exposed to radiation and, thus, provides an indicator as to how many and what types of microorganisms must be killed by the sterilization dose of radiation to achieve $10^{-6}$ SAL. The bioburden of a product sample is influenced by many factors including, for example, the raw materials, manufacturing processes, personnel procedures, and environment. After concluding the bioburden test, Table 5 of ANSI/AAMI/ISO 11137-2:2006 is consulted to identify a sterilization dose corresponding to the average bioburden value determined from the bioburden test data.

Prior to applying the sterilization dose to products for commercial distribution, the sterilization dose must first be verified against the resistance of various microorganisms. To evaluate the resistance of microorganisms (i.e., bioburden), a sterility test is performed on a number of product samples irradiated at a dose that is less than the normal sterilization dose. This dose, referred to as the verification dose, is also identified in Table 5 of ANSI/AAMI/ISO 11137-2:2006 using the results of the bioburden test mentioned above to give a Sterility Assurance Level (SAL) of $10^{-2}$. If, after the completion of the sterility test, one or no positive sterility samples are identified, the original sterilization dose is acceptable and no action is required. A positive sterility sample is a test sample that exhibits detectable microbial growth after incubation. If, after completion of the sterility test, two or more positive sterility samples are obtained, the original sterilization dose is not acceptable and dose augmentation may be appropriate as specified in ANSI/AAMI/ISO 11137:2006 or alternative methods of sterilization should be pursued.

Determining and Verifying Dosages for Sterilization by Radiation

Testing was performed on samples of the surgical clipper 100 illustrated in FIGS. 5 and 6 in accordance with the above-referenced standards and guidelines to determine and verify a sterilization dose for the surgical clippers. The clippers were manufactured from materials including ABS and various metals.

First, a Bioburden Test was performed on three lots of ten surgical clippers to determine a verification dosage. The three lots, Lots A-C, of ten surgical clippers were obtained after manufacture, assembly and packaging but prior to any sterilization process. In other words, the sample surgical clippers were non-sterile surgical clippers. Under these circumstances, the Bioburden Test provided an indication of the total number of viable organisms in or on a surgical clipper that would be expected to result from the manufacturing, assembly and packaging processes.

The batteries were removed from the surgical clippers as the batteries would leak when exposed to the chemicals used in the Bioburden Test. Each of the surgical clippers was then placed into an individual sterile container containing 200 mL of rinsing fluid. The containers were then sonicated for five minutes and hand shaken for one minute to facilitate the transfer of microbes from the surgical clippers to the rinsing fluid. An aliquot of 40 mL of the rinsing fluid from each container was then plated and incubated according to standard methods to count the number of microorganisms removed from each surgical clipper. The type of plate media utilized determines the type of microbe that can be detected. For example, tryptic soy agar (TSA) is a bacterial growth medium and rose bengal agar (RBA) is a fungi growth medium. Additionally, the temperature and duration of the incubation process depends on the type of plate media utilized as is commonly known by one of ordinary skill in the art. Plate media and incubation processes were selected in accordance with standard methods to enumerate three classes of microbes removed from the surgical clippers: total aerobic count, total fungi count and total spore-formers.

The number of bioburden for each surgical clipper in the three lots is indicated for each of the three microbe classes in Tables 1-3. The bioburden is indicated in terms of colony forming units (CFU), where one CFU represents one viable microorganism. For each lot, a "Batch Average" of each microbe class was determined by averaging the bioburden (i.e., the microbe count in a microbe class) of all surgical clippers in that lot. As described above, the data shown in Tables 1-3 provides an indication of the expected number and type of microbes that may be present in or on a surgical clipper after manufacturing, assembly and packaging.

TABLE 1

| Lot A Total Count (Recovered CFU/sample) | | | |
|---|---|---|---|
| Sample ID | Aerobes | Fungi | Spores |
| 1 | 420 | 5 | 480 |
| 2 | 690 | <5 | 15 |
| 3 | 140 | <5 | 40 |
| 4 | 50 | 10 | 50 |
| 5 | 35 | <5 | 40 |
| 6 | 55 | 5 | 10 |
| 7 | 75 | <5 | 35 |
| 8 | 80 | <5 | 35 |
| 9 | 40 | <5 | 230 |
| 10 | 85 | 5 | 10 |
| Batch Average | 167.0 | 5.5 | 94.5 |
| Correction Factor = 1.6 Corrected Batch Average | 267.2 | 8.8 | 151.2 |

TABLE 2

| Lot B Total Count (Recovered CFU/sample) | | | |
|---|---|---|---|
| Sample ID | Aerobes | Fungi | Spores |
| 1 | 130 | 15 | 60 |
| 2 | 25 | 5 | 15 |
| 3 | 220 | 5 | 240 |
| 4 | 270 | <5 | 180 |
| 5 | 60 | 10 | 100 |
| 6 | 55 | <5 | 85 |
| 7 | 35 | <5 | 20 |
| 8 | 45 | 5 | 55 |
| 9 | 5 | <5 | 50 |
| 10 | 180 | 5 | 140 |
| Batch Average | 102.5 | 6.5 | 94.5 |
| Correction Factor = 1.6 Corrected Batch Average | 164.0 | 10.4 | 151.2 |

TABLE 3

| Lot C Total Count (Recovered CFU/sample) | | | |
|---|---|---|---|
| Sample ID | Aerobes | Fungi | Spores |
| 1 | 55 | 10 | 40 |
| 2 | 65 | <5 | 40 |
| 3 | 70 | 5 | 30 |
| 4 | 300 | 10 | 190 |
| 5 | 300 | 5 | 60 |
| 6 | 80 | 10 | 45 |
| 7 | 35 | 35 | 55 |
| 8 | 85 | <5 | 80 |
| 9 | 120 | <5 | 140 |
| 10 | 3600 | <5 | 40 |
| Batch Average | 471.0 | 9.5 | 72.0 |
| Correction Factor = 1.6 Corrected Batch Average | 753.6 | 15.2 | 115.2 |

Because 100% of the bioburden is not transferred from a surgical clipper to the rinsing fluid by the sonication and handshaking process described above, a correction factor is applied to each Batch Average to achieve a more accurate representation of the actual bioburden on a surgical clipper (indicated as "Corrected Batch Average" in Tables 1-3). In this case, a correction factor of 1.6 was determined by performing multiple iterations of sonication and handshaking on a test surgical clipper (i.e., a surgical clipper not included in the three lots of the Bioburden Test) until the last iteration transferred insignificant additional bioburden from the test surgical clipper to the rising fluid. The bioburden count determined after the final iteration was divided by the bioburden count determined after the first iteration to compute the correction factor.

Now referring to Table 4, an "Average Bioburden" was determined for each lot by summing the Corrected Batch Averages for Aerobes and Fungi of each lot. The Corrected Batch Average for Spores was omitted from the Average Bioburden of a lot because the Spores average is subsumed within the Aerobes average. Because the Bioburden Test was performed on the entire surgical clipper, the "sample item portion" (SIP) was equal to one and, thus, the Average Bioburden did not need to be further adjusted. The "Overall Average" bioburden for Lots A-C was determined to be 406.4 CFU/surgical clipper from the Average Bioburdens of Lot A, B and C as indicated in Table 4. Table 4 also indicates that the Average Bioburden of each lot was not greater than or equal to twice the Overall Average. As such, the Overall Average of 406.4 CFU/surgical clipper was determined to be the bioburden count used to set the verification dose and sterilization dose. If on the other hand, a particular lot's Average Bioburden had been greater than or equal to twice the Overall Average, that lot's Average Bioburden would have been used as the bioburden count used to set the verification dose and sterilization dose.

TABLE 4

| Lot No. | Average Bioburden | Average Bioburden/SIP (SIP = 1.0) | Average ≧ 2x the overall average? |
|---|---|---|---|
| A | 276.0 | 276.0 | No |
| B | 174.4 | 174.4 | No |
| C | 768.8 | 768.8 | No |
| Overall Average | 406.4 | 406.4 | |
| BIOBURDEN COUNT USED TO SET VERIFICATION DOSE | | | 406.4 |
| BIOBURDEN COUNT USED TO SET STERLIZATION DOSE | | | 406.4 |

Next, Table 5 in ANSI/AAMI/ISO 11137-2:2006 was consulted to identify the verification dose and sterilization dose that correspond to an overall average bioburden of 406.4 CFU/product sample. The verification dose was identified as 9.8 kilogreys (kGy) and the sterilization dose was identified as 23.5 kGy. A verification dose range was determined to be 9.8-10.7 kGy by identifying the verification dose of 9.8 kGy as a minimum and 110% of the verification dose as a maximum. A sterilization dose range was identified as 23.5-50.0 kGy.

To verify that this sterilization dose will actually achieve $10^{-6}$ SAL for the surgical clippers, one hundred (100) surgical clipper samples were irradiated at a radiation level within the verification dose range (i.e., 9.8-10.7 kGy) and subjected to a sterility test. First, the batteries were removed as the batteries would leak if subjected to the chemicals used in the sterility test. Each of the samples was then immersed in 400 mL of liquid media (e.g., soy bean caseine digest) and incubated for fourteen (14) days. After the incubation period, each sample was visually inspected to check turbidity. A cloudy liquid media indicated that microorganisms were growing and a positive test result (i.e., a failed test). A non-cloudy liquid media indicated no microorganism growth and a negative test result (i.e., a passed test). In this case, all one hundred (100) samples were negative indicating that the sterilization dose previously determined from the Bioburden Test was adequate. Thus, a sterilization dose of at least 23.5 kGy was verified as adequate to meet the FDA's expectation of achieving a $10^{-6}$ Sterility Assurance Level (SAL) such that the surgical clippers would be considered to have an absence of microorganisms.

Functionality Integrity and Battery Life Testing

Additional testing was performed to verify clipper functionality (e.g., on/off button functioning and cutting function), material integrity (e.g., material tensile strength, discoloration, and presence of cracks or fractures), and battery life of the surgical clipper after being subjected to the radiation sterilization process. Further, the testing verified the package integrity and seal strength.

One hundred ninety (190) surgical clipper samples were shipped directly from the manufacturing plant to the testing laboratory. All one hundred ninety (190) samples were momentarily turned on to confirm that they were operational. All samples were operational. One hundred twenty (120) samples were visually inspected and clearly marked with an "R" before being subjected to a radiation dosage of approximately 52.1 kGy, which is double the minimum sterilization dosage. After irradiation, the one hundred twenty (120) samples were momentarily turned on to confirm that they remained operational. All irradiated samples remained operational. The remaining unmarked samples were designated as control samples.

Forty (40) of the control samples and eighty (80) of the irradiated samples were placed in a 55° Celsius oven to accelerate the affects of aging according to the testing standard ASTM F1980, entitled "Standard Guide for Accelerated Aging of Sterile Barrier Systems for Medical Devices." The remaining control and irradiated samples were left at room temperature. At each of the accelerated conditions corresponding to 1 month, 3 months, 6 months, 12 months and 18 months accelerated aging, one set of five (5) control and one set of five (5) irradiated clippers were visually examined for defects and run for a minimum of eight (8) hours or until they ceased to function acceptably (i.e., the blades no longer oscillated). Similarly, at 0 days and 1 month of actual time at room temperature, one set of five (5) control and one set of five (5) irradiated clippers were visually examined for defects and run for a minimum of eight (8) hours or until they ceased to function acceptably. The results of the functionality tests are indicated in Table 5.

TABLE 5

| Aging Time | Clipper | Avg. Run Time (hours) | # That Turned On | # That Cut |
|---|---|---|---|---|
| 0 days at room temperature | Sterile | 8.7 | 5 of 5 | 5 of 5 |
| | Control | 8.35 | 5 of 5 | 5 of 5 |
| 1 month at room temperature | Sterile | 7.85 | 5 of 5 | 5 of 5 |
| | Control | 8.25 | 5 of 5 | 5 of 5 |
| 1 month simulated = 4 days in oven | Sterile | 8.5 | 5 of 5 | 5 of 5 |
| | Control | 8.85 | 5 of 5 | 5 of 5 |
| 3 months simulated = 10 days in oven | Sterile | 8.4 | 5 of 5 | 5 of 5 |
| | Control | 7.65 | 5 of 5 | 5 of 5 |
| 6 months simulated = 19 days in oven | Sterile | 7.5 | 4 of 5 | 5 of 5 |
| | Control | 7.0 | 5 of 5 | 4 of 5 |
| 12 months simulated = 38 days in oven | Sterile | 8.1 | 5 of 5 | 5 of 5 |
| | Control | 8.1 | 5 of 5 | 5 of 5 |
| 18 months simulated = 57 days in oven | Sterile | 5.0 | 4 of 5 | 5 of 5 |
| | Control | 8.2 | 5 of 5 | 5 of 5 |

This test indicated whether the battery life will persist in warehouses after sterilization such that the customer will ultimately receive a surgical clipper that is operable once the sterile package is opened in the sterile setting and the sterile clipper is turned on. In some embodiments, it is desirable that the battery can be operated for at least about 15-30 minutes after the sterile clipper is turned on. The battery use time may actually be significantly greater than 15-30 minutes, i.e., up to about 60 minutes or greater. For the testing referenced with respect to Table 5, all functional clippers passed the minimum one hour running time with the lowest value of 3.5 hours occurring on one of the sterile clippers tested after 57 days at 55° Celsius.

Those irradiated clippers that were inspected also passed the visual examination tests. There was a slight discoloration of the both the gray bodies and blue on/off membranes and protective covers after sterilization. The discoloration was only noticeable when compared to the control samples and became slightly more pronounced with aging.

In further testing, the package integrity was successfully verified for all test samples by immersing the clipper and package kit in a dye to determine whether any dye leaked into the package. Additionally, the material integrity of the samples was successfully verified by performing tensile strength tests, which resulted in no significant difference between irradiated samples and control samples.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A kit for a disposable, sterilized surgical clipper comprising:

a surgical clipper including a body having a top portion and a bottom portion, a clipper head adapted to attach to the top portion of the body and a power source for operating the surgical clipper, wherein the clipper head includes a housing and a blade assembly, the body and the housing being made from a high grade thermoplastic material capable of withstanding sterilization without breaking or fracturing, the high grade thermoplastic material including less than about 1% impurities; and a package for holding the surgical clipper, the package and enclosed surgical clipper being sterilized such that the surgical clipper can be used in a sterile setting.

2. The kit of claim 1, wherein the sterilization is gamma radiation.

3. The kit of claim 1, wherein the thermoplastic material comprises one or a combination of high grade acrylonitrile butadiene styrene, high grade nylon, and high grade polyoxymethylene.

4. The kit of claim 1, wherein the power source is one or more disposable batteries.

5. The kit of claim 1, wherein the surgical clipper further comprises internal components that are made of thermoplastic and non-thermoplastic materials.

6. The kit of claim 5, wherein the non-thermoplastic components comprise metal and rubber.

7. The kit of claim 5, wherein the internal components are comprised of metal, silicone, thermoplastic elastomers, rubber, latex, polyester, polyisoprene, nitrile, urethane and combinations thereof.

8. The kit of claim 1, wherein the surgical clipper is disposed of after a single use.

9. The kit of claim 1, the body and the clipper head are formed as a single, integrated unit.

10. A kit for a sterilized surgical clipper comprising:

a surgical clipper including:

a body having a top portion and a bottom portion, a clipper head adapted to attach to the top portion of the body, the clipper head includes a housing and a blade assembly, and a power source for operating the surgical clipper, wherein the body, the clipper head, and the power source are made from materials capable of withstanding a sterilization process without breaking or fracturing, the body and the housing being made from a high grade thermoplastic material including less than about 1% impurities; and a package for enclosing the surgical clipper, the package and enclosed surgical clipper being sterilized such that the surgical clipper can be used in a sterile setting.

11. The kit of claim 10, wherein the sterilization process is gamma radiation.

12. The kit of claim 11, wherein the gamma radiation is at a dosage between 50 kilogreys to 60 kilogreys.

13. The kit of claim 10, wherein the thermoplastic material comprises one or a combination of high grade acrylonitrile butadiene styrene, high grade nylon, and high grade polyoxymethylene.

14. The kit of claim 10, wherein the thermoplastic material comprises high grade acrylonitrile butadiene styrene.

15. The kit of claim 10, wherein the thermoplastic material comprises high grade polyoxymethylene.

16. The kit of claim 10, wherein the power source is one or more disposable batteries.

17. The kit of claim 10, wherein the surgical clipper further comprises internal components that are made of thermoplastic and non-thermoplastic materials.

18. The kit of claim 17, wherein the non-thermoplastic components comprise metal and rubber.

19. The kit of claim 17, wherein the internal components are comprised of metal, silicone, thermoplastic elastomers, rubber, latex, polyester, polyisoprene, nitrile, urethane and combinations thereof.

20. The kit of claim 10, the body and the clipper head are formed as a single, integrated unit.

21. A kit for a disposable, sterilized surgical clipper comprising:

a surgical clipper including a body having a top portion and a bottom portion, a clipper head adapted to attach to the top portion of the body and a power source for operating the surgical clipper, wherein the clipper head includes a housing and a blade assembly, the body and the housing being made from a high grade thermoplastic material capable of withstanding sterilization without breaking or fracturing, the high grade thermoplastic material including less than about 1% impurities, the high grade thermoplastic material including an additive to promote more efficient bonding during a molding process; and a package for holding the surgical clipper, the package and enclosed surgical clipper being sterilized such that the surgical clipper can be used in a sterile setting.

22. The kit of claim 21, wherein the additive includes a free radical scavenger.

* * * * *